United States Patent [19]

De La Rocha

[11] Patent Number: 5,020,553

[45] Date of Patent: Jun. 4, 1991

[54] LIPSTICK APPLICATOR

[76] Inventor: Daniel D. De La Rocha, 5376 W. 14th La., Hialeah, Fla. 33012

[21] Appl. No.: 456,505

[22] Filed: Dec. 26, 1989

[51] Int. Cl.[5] ..... A45D 40/26

[52] U.S. Cl. ..... 132/320

[58] Field of Search ..... 132/319, 320; 229/74, 229/76, 84, 92.8

[56] References Cited

U.S. PATENT DOCUMENTS

| | | | |
|---|---|---|---|
| 1,107,977 | 8/1914 | Miller | 132/320 |
| 1,459,414 | 6/1923 | Parks | 229/76 |
| 1,885,076 | 10/1932 | Bustamente | 132/320 |
| 2,372,777 | 4/1945 | Gormen | 132/320 |
| 2,606,565 | 8/1952 | Sage, Sr. | 132/320 |
| 2,735,435 | 2/1956 | Feinstein | 132/320 |
| 3,177,879 | 4/1965 | Smith | 132/320 |
| 4,611,611 | 9/1986 | Beal, Jr. | 132/320 |

*Primary Examiner*—John J. Wilson
*Assistant Examiner*—Frank A. LaViola
*Attorney, Agent, or Firm*—Robert A. Spray

[57] ABSTRACT

A lipstick applicator composed of a sheet of paper having a rounded lower edge, an upper edge to be grasped and pair of side edges extending between the upper and lower edges and wherein a lower zone of the sheet on the opposite main faces is coated with lipstick to be removed by grasping the card between the lips of a user and pulling outwardly, wherein the applicator preferably includes an envelope sized to receive the applicator card and protectively jacket the same until ready for use.

6 Claims, 1 Drawing Sheet

LIPSTICK APPLICATOR

BACKGROUND OF THE INVENTION

1. Field of the Invention

This invention relates to lipstick applicators and more particularly, to a lipstick applicator composed of a card having opposite main faces coated with lipstick while the card is normally housed in an envelope sized to jacket the applicator card so that the card may be removed and the lipstick coated surfaces of the card grasped by the lips of a user and as the card is withdrawn from the mouth, lipstick is applied to the lips of the user.

2. Description of the Prior Art

As is perhaps well known, lipstick sampling by prospective customers at counters in department stores, markets and the like is beset with certain problems not the least of which is the transference of germs if the lipstick devices are utilized by several customers. Notwithstanding this obvious problem, many women desire to try many different colors and, also, the products of many different manufacturers. Some persist in applying the lipstick directly to their lips even though others have used the same device. Some, knowing of the problem of contamination and germs, apply the lipstick to their hands, for example, on the palms. Generally speaking, there has been a need for a lipstick applicator device which could present a wide variety of lipstick colors by different manufacturers. Additionally, there is a marketing need for the capability of providing by mail to prospective customers samples of a manufacturer's lipstick in various shades.

Accordingly, it is an object of this invention to provide a lipstick applicator which is composed of a card jacketed in an envelope from which the card can be easily removed and on which a portion which has a rounded leading edge is coated with a selected color of lipstick on both sides thereof so that the user may insert the rounded leading edge into the mouth and while applying pressure, remove the card so that the lipstick is transferred from the card to the lips of the user. In this way, the applicator is not only disposable and inexpensive but, also, can be packaged in a transparent envelope so that it is protectively jacketed in a hygienic condition prior to use and can be easily removed for sampling of lipsticks. For example, a manufacturer could mail several different shades to a prospective purchaser who could then, in the privacy of their own home, select a color or colors which they like most and dispose of the samples. Moreover, the samples when jacketed in the envelope can be carried in the purse of a user and in any event, the sampling is fast and simple because both lips are coated simultaneously as opposed to the conventional lipstick applicator wherein one lip is coated with lipstick following which the other lip is coated.

Summary of the Invention

It is a general object of this invention to provide a lipstick applicator which includes a card having a lower portion with a rounded leading edge, the lower portion being coated with lipstick on opposite main faces and sized to be inserted into the mouth of a user so that by applying pressure to the opposite main faces of the card with the lips, lipstick is applied simultaneously to both of the lips of the user as the card is withdrawn from the user's mouth. The card may be protectively jacketed prior to use in an envelope, preferably transparent for viewing of the lipstick shade or color, wherein the envelope includes a flap means which can be broken and folded into the main plane of the envelope and card therein, thereby facilitating removal of the card from the envelope. The envelope further includes a tab disposed on a lower edge which is specifically designed to be grasped by the user when extracting the card from the envelope, thereby avoiding the need to grasp the sides of the envelope which would cause lipstick to be removed from the card. The present invention has the advantages which are set forth hereinabove and which will be more apparent from the description which follows.

DESCRIPTION OF THE DRAWINGS

In accordance with the general object of this invention and as set forth more fully herein, the instant invention will now be described on reference to the accompanying drawings, of which.

DETAILED DESCRIPTION OF THE PREFERRED EMBODIMENT

Figure 1:
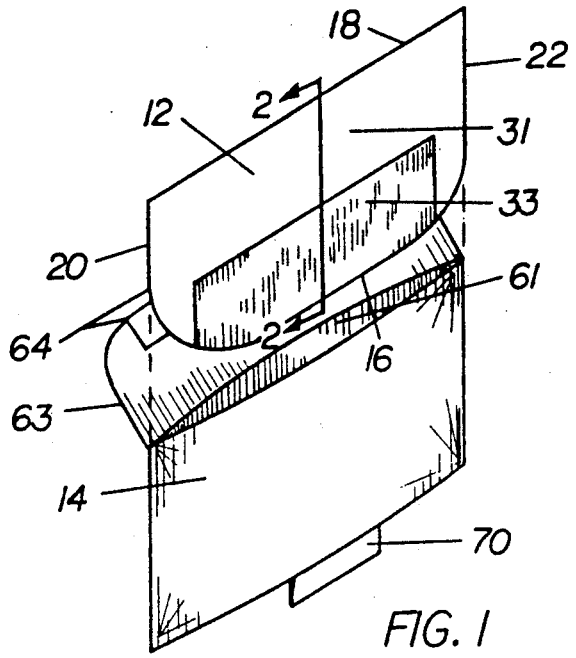
FIG. 1 is an exploded view illustrating the lipstick applicator card in relation to an envelope in which it is normally protectively jacketed.
Figure 2:
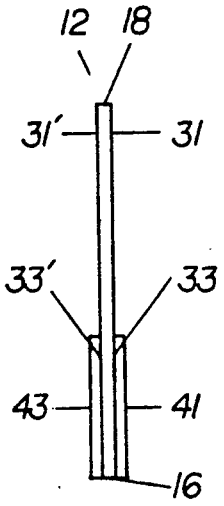
FIG. 2 is a view in cross-section taken on the plane indicated by the line 2—2 of FIG. 1 looking in the direction of the arrow and showing the lipstick applicator sheet or card in cross-section.
Figure 3:
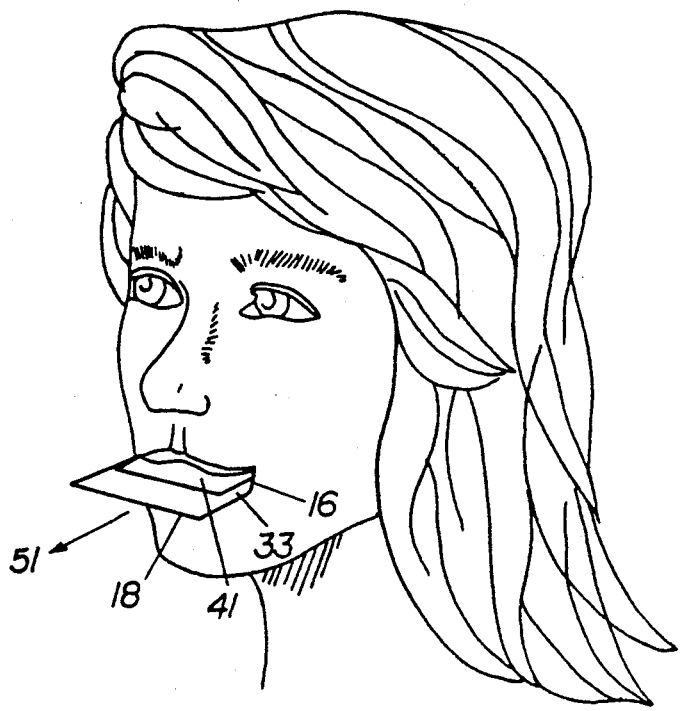
FIG. 3 is a general view illustrating the use of the instant invention.

Referring to the drawings wherein like reference characters designate like or corresponding parts throughout the several views and referring particularly to FIG. 1, there is seen a lipstick applicator card 12 and an envelope 14 which is sized to receive and protectively house the sheet or card 12. Referring more particularly to the sheet or card 12 which can be considered to be a lipstick applicator, it is seen to be composed of a sheet having a rounded lower or leading edge 16 and an upper edge 18, the upper and lower edges spanning side edges 20 and 22. Preferably the card or sheet is about the size of a conventional business card, that is about two and one-half inches between the side edges 20 and 22 and about one and one-quarter to one and one-half inches between the upper edge 18 and the rounded lower edge 16. Midway between the side edges 20 and 22 is the extremity of the rounded leading edge 16 which is sized to be inserted into the mouth of a user as seen in FIG. 3, for a purpose to be explained more fully hereinafter. As is seen in FIG. 1, the main faces of the card or sheet 18, each have an upper zone 31 and a lower zone 33, the reverse side of the card being the same as that shown in FIG. 1. The upper zone extends about one-third of the distance along each of the side edges toward the lower zone. The surface of the lower zone of the card 12 may be roughened and in any event, both sides of the card on the surfaces 33, 33' of the lower zone are coated with a selected shade of lipstick. The coating being generally indicated by the numerals 41 and 43 in FIG. 2.

In use, the card is inserted into the mouth of a user with the leading edge 16 being within the mouth and with the lips of a user being adapted to confrontingly grasp the card on the lower zone surfaces 33, 33' so that the lipstick coating thereon 41 and 43 may be applied to the lips of the user as the card is withdrawn from the mouth while being grasped as indicated by the arrowed line 51. When not in use, the lipstick applicator card is normally protectively jacketed in the envelope 14 which is sized to contain the card with the leading edge in the bottom and the upper edge 18 being adjacent an opening 61 in the envelope between the confronting surfaces thereof. Preferably a flap means 63 is hingedly attached for folding, swinging movement from a normal covered relationship of the opening into a generally coplanar relation with the card and the envelope so that there is access to the upper edge of the card whereby the upper zones 31, 31' may be grasped to remove the card from the envelope for use. The flap means 63 includes a raised distal edge 64 which is folded back so as to extend outwardly and away from the envelope when the flap 63 is in the closed position, thus providing a gripping surface to facilitate opening of the flap. The envelope 14 further includes a tab 70 extending downwardly from a bottom peripheral edge of the envelope The tab 70 is specifically designed to be grasped between the fingers of the user when removing the card 12 from the envelope, thereby avoiding the need to grasp the sides of the envelope and causing the lipstick coating 41 and 43 to be smeared or removed from the card surface.

While in the preferred embodiment, the card is of wax paper as is the envelope, the envelope being transparent for the purpose of viewing the shade of the lipstick, other types of materials may be utilized; however, it is preferred that wax paper be utilized. Generally, it is also preferable that the lower zones of the sheet, that is 33 and 33', be roughened somewhat prior to the application of the coating of lipstick so that it adheres to it. It is thus seen that there has been provided a simple inexpensive disposable lipstick applicator which can be utilized for trying samples applying the lipstick to a user's lips without danger of spreading germs and which is fast since both lips are coated simultaneously with the curved leading edge being received in the mouth and skin cuts being avoided by reason of the smooth edge so that a wide variety of samples may be provided and utilized as samples in stores or, indeed, by mailing samples to prospective purchasers.

While the instant invention has been shown and described in what is considered to be a practical and preferred embodiment, it is recognized that departures may be made within the spirit and scope of this invention which is therefore not to be limited except as set forth in the claims which follow within the doctrine of equivalents.

What is claimed is:

1. A lipstick applicator for use in applying lipstick by a user comprising:

a sheet of paper having opposite main faces with an upper and lower edge and side edges spaced from one another a distance of about two and one-half inches, said upper edge spanning said side edges and said lower edge defining a fair curve between the side edges symmetrical with respect to a centerline between the side edges of the sheet, said lower edge defining a leading edge for use, each of said opposite main faces having an upper zone and a lower zone extending between the side edges, the upper zones extending from the upper edge about one-third of the distance between the upper and lower edges, a coating of lipstick on the lower zones on the opposite main faces of the sheet, an envelope formed from a wax coated paper having an entrance/exit slot, said envelope normally protectively jacketing the sheet, said envelope including flap means to foldably close with respect to the slot to captivate the sheet within the envelope with the upper zone of the sheet being accessible when the flap means are generally coplanar with the envelope and the sheet for removal of the sheet by grasping it at the slot, and said sheet being useful for applying lipstick to upper and lower lips of a user by inserting the leading edge into a mouth of the user and grasping the coated lower zone with the lips and applying pressure to opposite sides of the lower zone of the sheet so that some of the lipstick adheres to the lips of the user upon withdrawing the sheet from the user'mouth, said flap means on the envelope including an outwardly extending free distal edge defining a gripping surface to facilitate opening thereof, and said envelope including a tab attached to and extending from a bottom peripheral edge of the envelope for grasping by the user to prevent smudging of the coating of lipstick during removal of said sheet of paper from the envelope.

2. The applicator as set forth in claim 1 wherein advertising indicia are arranged on the upper zone on at least one of said opposite main faces.

3. The applicator as set forth in claim 1 wherein said lower zones on the opposite main faces are provided with a roughened surface for easy adherence of the lipstick coating thereto.

4. The applicator as set forth in claim 1 wherein said sheet of paper is provided with an impervious coating on said lower zones to provide for adherence of the lipstick to the sheet.

5. The applicator as set forth in claim 4 wherein said sheet of paper is wax coated paper.

6. The applicator as set forth in claim 1 wherein the envelope is of transparent sheet material for viewing of the lipstick color.

* * * * *